US008442258B2

(12) United States Patent
Kimura

(10) Patent No.: US 8,442,258 B2
(45) Date of Patent: May 14, 2013

(54) HEADPHONE

(75) Inventor: Tominori Kimura, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 189 days.

(21) Appl. No.: 13/014,194

(22) Filed: Jan. 26, 2011

(65) Prior Publication Data

US 2011/0188696 A1 Aug. 4, 2011

(30) Foreign Application Priority Data

Feb. 3, 2010 (JP) ..... 2010-021826

(51) Int. Cl.
*H04R 25/00* (2006.01)

(52) U.S. Cl.
USPC ..... 381/378; 381/371

(58) Field of Classification Search ..... 381/371, 381/372, 374, 376, 378
See application file for complete search history.

(56) References Cited

U.S. PATENT DOCUMENTS

| | | | | |
|---|---|---|---|---|
| 4,922,542 | A * | 5/1990 | Sapiejewski | 381/373 |
| 8,180,091 | B2 * | 5/2012 | Sokolich et al. | 381/371 |
| 8,199,955 | B2 * | 6/2012 | Akino | 381/374 |
| 2002/0085733 | A1 * | 7/2002 | Cottrell | 381/371 |
| 2011/0002475 | A1 * | 1/2011 | Kimura | 381/71.6 |

FOREIGN PATENT DOCUMENTS

JP 2009-017176 1/2009

* cited by examiner

*Primary Examiner* — Brian Ensey
*Assistant Examiner* — David J Ho
(74) *Attorney, Agent, or Firm* — Whitham Curtis Christofferson & Cook, PC

(57) ABSTRACT

A headphone including a headband, an ear cup attached to the headband, a baffle plate fixed to the ear cup and having a rib wall at its periphery, an ear pad engaged with the baffle plate, and a gas permeable buffer between the ear cup and the baffle plate, wherein the buffer and the rib wall prevent a reduction in volume of a front air chamber caused by lateral pressure.

6 Claims, 4 Drawing Sheets

HEADPHONE

TECHNICAL FIELD

The present invention relates to a headphone that includes a buffer provided between a baffle plate and an ear pad, that can prevent a reduction in volume of a front air chamber caused by lateral pressure, and that exhibits improved quality of sound in low to medium frequency bands.

BACKGROUND ART

A closed headphone of which an ear pad is tightly put into close contact with user's ear auricle and its periphery, can highly insulate the user from ambient noise and prevent sound from leaking to the exterior. Furthermore, a closed space defined by the ear pad provides a large volume of front air chamber, which is a space in front of the baffle plate and in communication with an ear canal. The space improves the quality of reproduced sound in low to medium frequency bands.

The structure of a typical conventional headphone is explained with reference to a longitudinal sectional-view in FIG. 4. The headphone 60 includes a front air chamber 64 that is a space defined by a baffle plate 62 fixed so as to block an opening of an ear cup 61 and an ear pad 63 fixed to the baffle plate 62 and that is in communication with user's ear canal. A speaker unit 65 is fixed to the baffle plate 62 in a back air chamber opposite to the front air chamber 64. The speaker unit 65 reproduces musical sound input from a sound source (not shown) and outputs the musical sound to the front air chamber 64.

The baffle plate 62 is a disk that has a central opening and a disk flange 621 having a central opening and a cylindrical rib protruding from the baffle plate 62. The baffle plate 62 and the flange 621 have different outer diameters. The baffle plate 62, the flange 621, and the cylindrical rib define a groove 622 over the entire circumference.

The ear pad 63 is composed of a substantially toroidal cushioning material covered with a skin, part of the skin being provided with a flap 631 of an elastic material. The ear pad 63 is engaged with the baffle plate 62 such that the flap 631 covers the flange 621.

The headphone 60 includes a headband (not shown) composed of a resilient material and attached to the outside (right in FIG. 4) of the ear cup 61. The other end of the headband is attached to another headphone having the same structure with headphone 60. The pair of (left and right) headphones constitutes a headphone system.

When a user wears the headphone 60 having such a structure in a determined posture, the ear pad 63 comes into close contact with the skin of his/her ear auricle and/or its periphery. This lateral pressure compresses the ear pad 63. The compression of the ear pad 63 enhances the close contact and thus comfort for the user to wear.

Compression of the ear pad 63, however, results in a reduction in volume of the front air chamber 64, which has been defined by the thickness of the ear pad 63. Since the volume of the front air chamber 64 influences the quality of reproduced sound in low to medium frequency bands as described above, the reduction in the volume adversely affects the quality of sound in low to medium frequency bands of the headphone 60.

In order to prevent the degradation of the quality of sound caused by such a reduction in volume of the front air chamber 64, the volume of the front air chamber 64 should be preliminarily increased. This requires a larger ear pad 63. The larger ear pad 63, however, requires an increase in size of the baffle plate 62 in proportion to the size of the ear pad 63, which also leads to an increase in size of the ear cup 61, resulting in an increase in size of the headphone 60 as a whole. Since an excessively large headphone is inconvenient for users, an increase in size of the ear pad 63 needs to be limited.

A known headphone is equipped with a substantial volume of a front air chamber isolated from a back air chamber without increase in size of an ear pad and has improved performance such as an enhanced sound insulation achieved by high passive transmission loss of external noise (for example, refer to Japanese Unexamined Patent Application Publication No. 2009-17176).

SUMMARY OF INVENTION

The headphone disclosed in Japanese Unexamined Patent Application Publication No. 2009-17176 also maintains the volume of the front air chamber by the thickness of the ear pad and thus does not solve the reduction in volume of the front air chamber caused by lateral pressure.

A measure for increasing the volume of the front air chamber is to form an opening on a side, facing the front air chamber, of the ear pad for connecting the inner space of the ear pad to the front air chamber. The opening of the ear pad, however, causes passive transmission of external noise through the opening. This leads to drastic changes in sound insulation characteristics of specific frequencies, resulting in the degradation in quality of sound contrary to expectation.

An object of the present invention, which has been accomplished to solve such problems, is to provide a headphone including a plurality of buffers having a predetermined rigidity between an ear pad and a baffle plate, and thereby capable of preventing a reduction in volume of a front air chamber caused by lateral pressure to improve quality of sound in low to medium frequency bands.

The present invention relates to a headphone including a headband, an ear cup attached to the headband, a baffle plate fixed to the ear cup and having a rib wall at its periphery, an ear pad engaged with the baffle plate, and gas-permeable buffers between the ear cup and the baffle plate, wherein the buffers and the rib wall prevent a reduction in volume of a front air chamber caused by lateral pressure.

The headphone may further include a buffer including a first buffer element having first rigidity at an inner periphery and a second buffer element having a second rigidity at an outer periphery, the first rigidity is higher than the second rigidity.

Preferably, the headphone includes a buffer including a first buffer element at an inner periphery, a second buffer element at an intermediate, and third buffer element at an outer periphery, the first, second, and third buffer elements having different rigidities, wherein the first buffer element comprises a gas-permeable material and has rigidity higher than that of the second buffer element, and the third buffer element comprises a gas-impermeable material and has rigidity higher than that of the second buffer element, and the third buffer element functions as a substitute for the rib wall.

Preferably, the buffer of the headphone is a cushion.

Preferably, the buffer in the headphone comprises an acoustic material having gas permeability.

Preferably, the buffer has a thickness greater than that of the ear pad.

Preferably, the buffer of the headphone comprises a more rigid member than the ear pad.

Preferably, the baffle plate of the headphone has a plurality of rib walls disposed inward of the ear pad in the radial direction.

The headphone of the present invention includes the buffer having a predetermined thickness provided between the front face of the baffle plate and the ear pad, and can prevent a reduction in volume of the front air chamber due to compression of the ear pad caused by lateral pressure of the headband, and thus can maintain the volume of the front air chamber which is especially effective for improving the quality of sound in low to medium frequency bands. The headphone of the present invention includes a plurality of buffers having different rigidities and can surely prevent a reduction in volume of the front air chamber caused by lateral pressure of the headband, maintaining a sufficient volume of front air chamber to improve quality of sound in low to medium frequency bands. The use of gas-permeable buffers can maintain a larger volume of front air chamber.

DESCRIPTION OF EMBODIMENTS

First Embodiment

Figure 1:
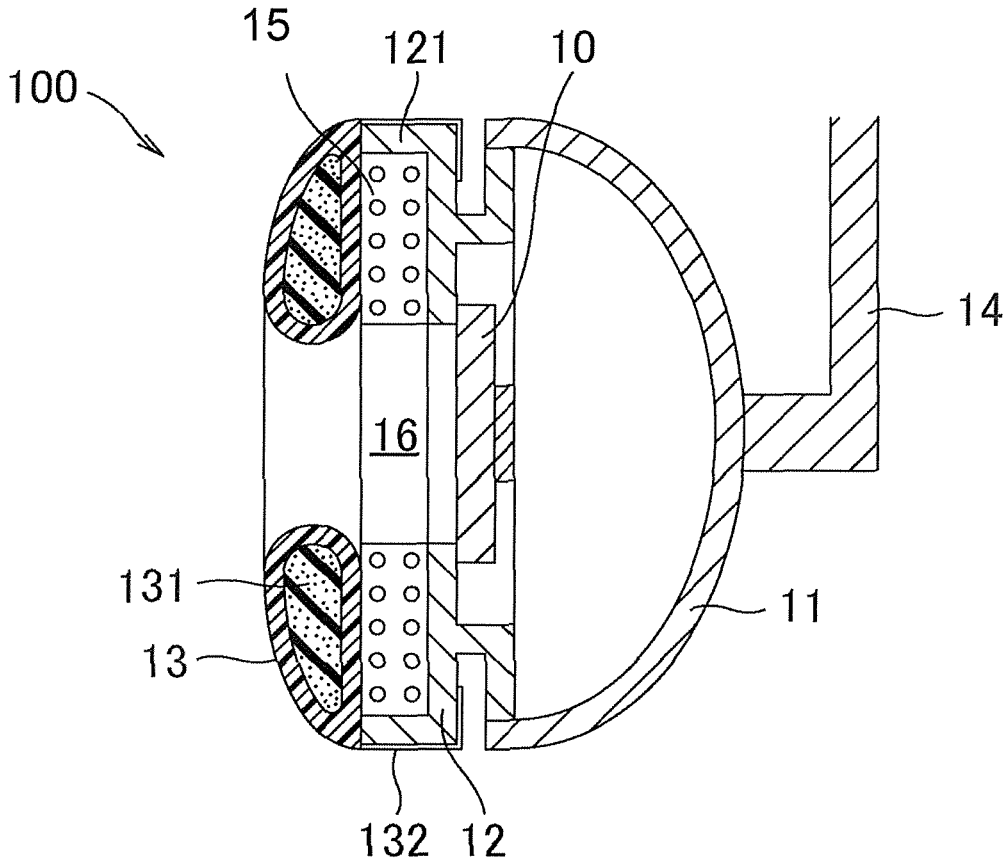
FIG. 1 is a longitudinal sectional-view illustrating a headphone of an embodiment of the present invention.

An embodiment of a headphone in accordance with the present invention will now be described with reference to the attached drawings. FIG. 1 is a longitudinal sectional-view of an exemplary headphone of the present invention. The headphone 100 includes a baffle plate 12 fixed to the opening of an ear cup 11, and an ear pad 13 engaged with the front face of the baffle plate 12 (left in FIG. 1).

The headphone 100 further includes a speaker unit 10 behind the baffle plate 12 that outputs audible signals. The speaker unit 10 reproduces musical sound from musical sound signals input from a sound source (not shown) and outputs the musical sound toward the front air chamber.

The baffle plate 12 is a disk having a central opening and has a disk flange having a central opening and a cylindrical rib protruding from the baffle palate 12. The baffle plate 12 and the flange have different outer diameters. The baffle plate 12, the flange, and the cylindrical rib define a groove over the entire circumference. The baffle plate 12 has a rib wall 121 that is a cylinder protruding from the periphery thereof. The rib wall 121 may be provided by bending the extended end of the baffle plate 12, or by bonding a cylindrical element to the baffle plate 12. The cylindrical element has an outer diameter substantially equal to the outer diameter of the baffle plate 12 and has a predetermined thickness.

The ear pad 13 includes a toroidal cushion 131 (e.g. sponge) and a skin covering the toroidal cushion 131, the skin having an extending engaging portion 132. The engaging portion 132 of the ear pad 13 is composed of an elastic material similar to that used in a conventional ear pad and is engaged with the periphery of the rib wall 121 of the baffle plate 12 by this elasticity. The engaging portion 132 may have a structure including a rubber material therein.

The ear cup 11 includes a headband 14 attached to the substantial center of the outer surface of the ear cup 11. The headband 14 is composed of a resilient member that exerts an pressing force toward the ear pad 13. The other end of the headband 14 is attached to another headphone (not shown) having the same structure. The cushion of the ear pad 13 can absorb the lateral pressure caused by the headphone 100 worn by a user having a predetermined posture and thus enhances the comfort for the user to wear.

A gas-permeable buffer 15 is disposed in a space defined by the rib wall 121 of the baffle plate 12, between the ear pad 13 and the baffle plate 12. The buffer 15 provides a front air chamber 16 surrounded by the front surface of the baffle plate 12 and the inner peripheral surface of the ear pad 13 and the buffer 15. The buffer 15 is a toroidal member having the same thickness as the height of the rib wall 121 and prevents a reduction in volume of the front air chamber 16 even if the ear pad 13 is compressed by lateral pressure. The buffer 15 may be bonded to the side of the baffle plate 12 or to the side of the ear pad 13.

The buffer 15 includes a gas-permeable material that has voids in its inside (e.g. cushioning material). The voids inside the buffer 15 can be included in the volume of the front air chamber 16.

The buffer 15 may include an acoustic material having a certain degree of rigidity and gas permeability, instead of the cushioning material. The acoustic material in the buffer 15 can suppress the generation of peaks and dips in specific frequency bands to further improve the quality of sound.

Thus, the headphone in accordance with this embodiment including the baffle plate having the rib wall and the buffer provided between the ear pad and the baffle plate can maintain a constant volume of the front air chamber without a reduction in volume caused by lateral pressure while the headphone is being worn. This leads to a reduction in resonant frequency of the front air chamber and improves the quality of sound in low to medium frequency bands.

Second Embodiment

Figure 2:
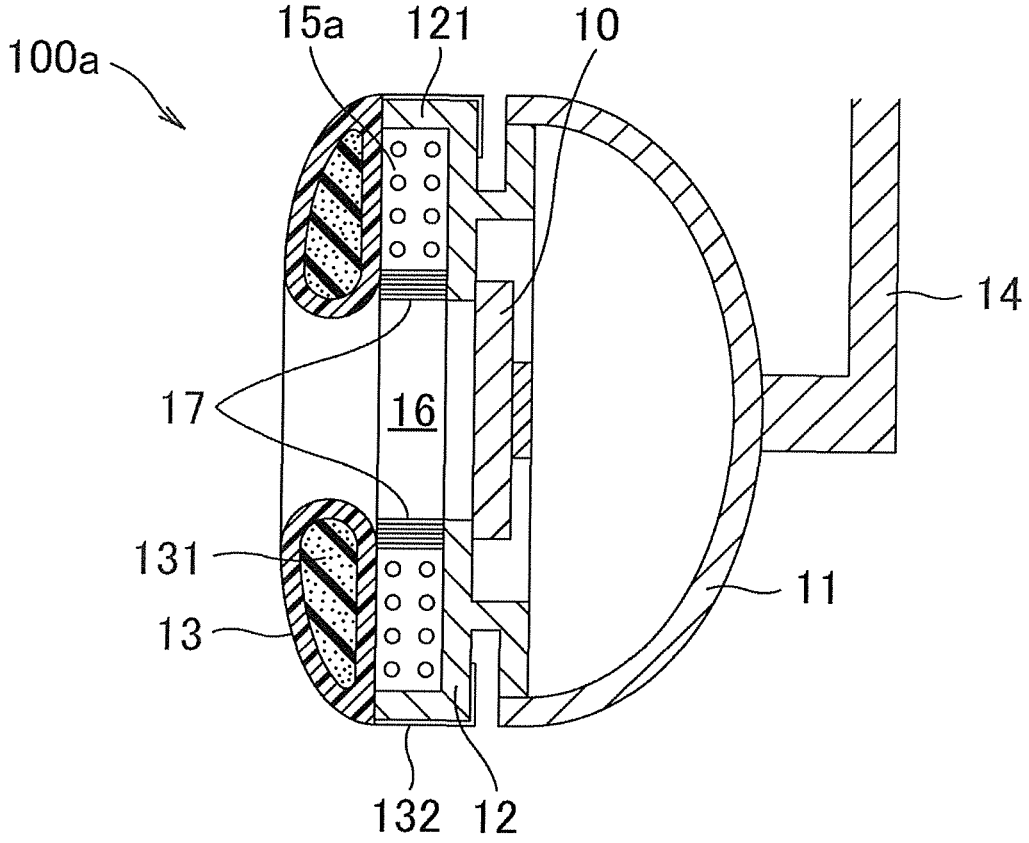
FIG. 2 is a longitudinal sectional-view illustrating a headphone of another embodiment of the present invention.

Another embodiment of the headphone in accordance with the present invention will now be described with reference to FIG. 2. As in the headphone 100 described in the first embodiment, a headphone **100*a* illustrated in FIG. 2 includes a buffer 15*a* provided between a baffle plate 12 having a rib wall 121, and an ear pad 13 engaged such that a engaging portion covers the outer circumference of the baffle plate 12**.

A buffer 17 having gas permeability and a higher rigidity than the buffer **15*a* is disposed to the inner circumference of the buffer 15*a*. The buffer 17 and the buffer 15*a* may be integrated by welding or bonding. These members may each be fixed to the baffle plate 12 or the ear pad 13**.

The headphone **100*a* fixed on a user's head can maintain a sufficient volume of front air chamber 16 without a reduction in volume of the chamber by the rigidity of the rib wall 121 of the baffle plate 12 and the buffer 17 even if the ear pad 13 is compressed by lateral pressure caused by a headband 14**. This improves the quality of sound in low to medium frequency bands.

The gas permeability of the buffer 17 enables voids inside the buffer **15*a* to function as part of the volume of the front air chamber 16**. This further improves the quality of sound in low to medium frequency bands.

Thus, the headphone in accordance with the present embodiment including the buffer 17 having high rigidity disposed to the inner circumference of the buffer **15*a* can maintain a certain volume of front air chamber 16 without a reduction in volume of the chamber even if the ear pad 13 is compressed by lateral pressure caused by the headband 14**.

This leads to a reduction in resonant frequency of the front air chamber and improves the quality of sound in low to medium frequency bands.

The headphone 100*a* in accordance with this embodiment may further includes a cylindrical rib wall having a predetermined height provided in front of the baffle plate 12 and along the inner circumference of the buffer 15*a* instead of the buffer 17 having high rigidity. The cylindrical rib wall provided in front of the baffle plate 12 should not cover the entire inner peripheral surface of the buffer 15*a*, but has dimensions that allows the front air chamber 16 and voids inside the buffer membrane 15*a* to communicate with each other and allows the ear pad 13 not to be compressed toward the baffle plate 12 by lateral pressure. The rib wall provided in front of the baffle plate also leads to a reduction in resonant frequency of the front air chamber and improves the quality of sound in low to medium frequency bands.

Thus, the headphone in accordance with the present invention including the gas permeable cushion having the same cushioning characteristics as the ear pad between the ear pad and the baffle plate, and the rib wall at the periphery of the baffle plate can prevent a reduction in volume caused by lateral pressure from the headband to maintain a constant volume without impairing the comfort for a user to wear. This leads to a reduction of a resonant frequency of the front air chamber and improves the quality of sound in low to medium frequency bands.

Third Embodiment

Figure 3:
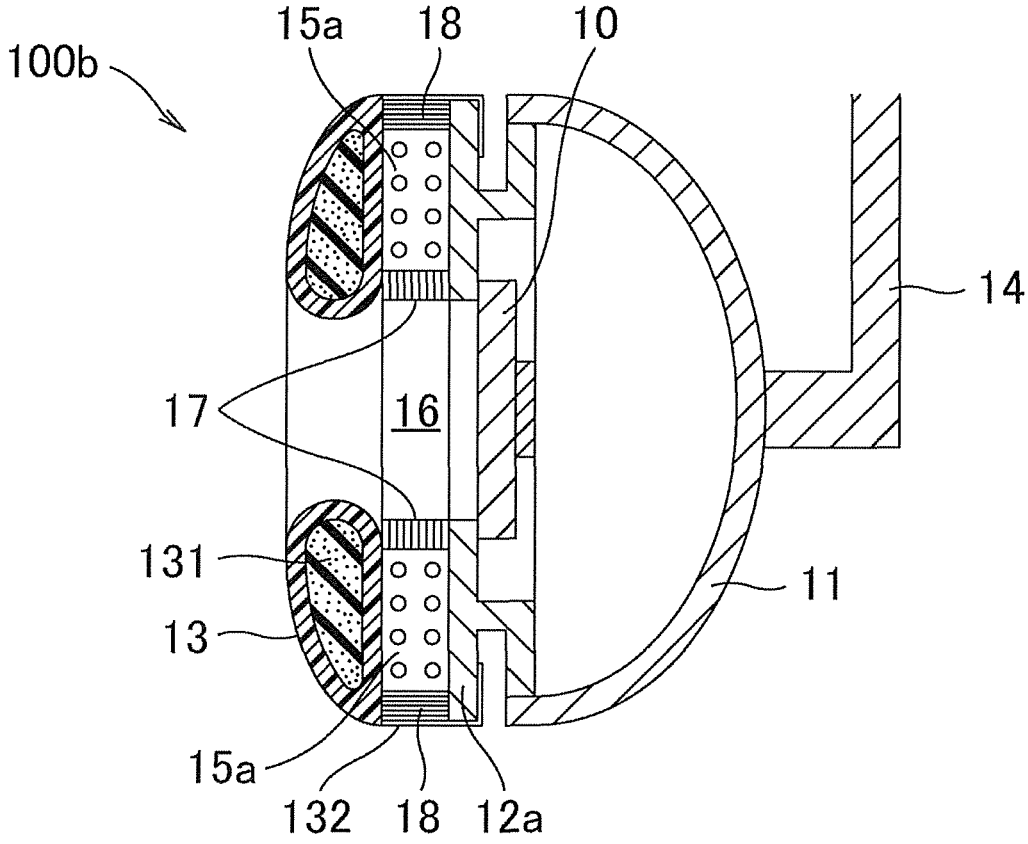
FIG. 3 is a longitudinal sectional-view illustrating a headphone of another embodiment of the present invention.
Figure 4:
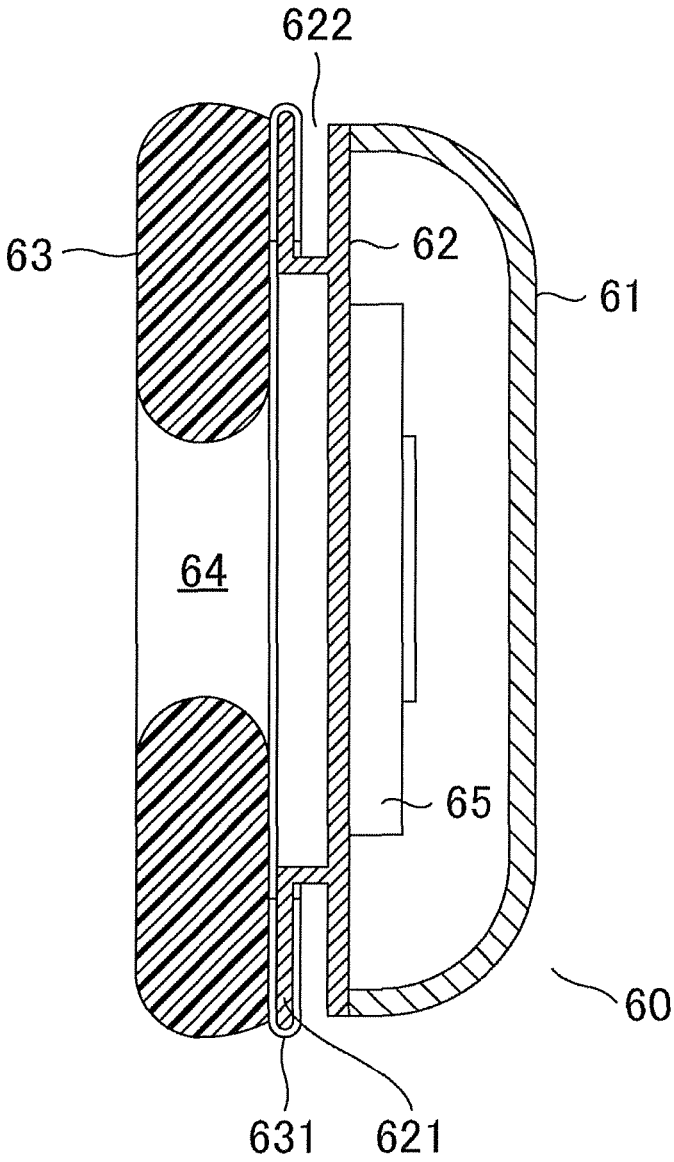
RELATED ART FIG. 4
FIG. 4 is a longitudinal sectional-view illustrating a typical conventional headphone.

Another embodiment of the headphone in accordance with the present invention will now be described with reference to FIG. 3. A headphone 100*b* includes a baffle plate 12*a* fixed to an opening of an ear cup 11, and an ear pad 13 engaged with the front face of the baffle plate 12*a* (left in FIG. 3).

The headphone 100*b* further includes a speaker unit 10 behind the baffle plate 12*a* that outputs audible signals. The speaker unit 10 reproduces musical sound from musical sound signals input from a sound source (not shown) and outputs the musical sound toward the front air chamber.

The baffle plate 12*a* is a disk having a central opening and has a disk flange having a central opening and a cylindrical rib protruding from the baffle plate 12*a*. The baffle plate 12*a* and the flange have different outer diameters.

The ear pad 13 includes a toroidal cushion 131 and a skin covering the toroidal cushion 131, the skin having an extending engaging portion 132. The engaging portion 132 of the ear pad 13 is composed of an elastic material similar to that used in a conventional ear pad and is engaged with the periphery of the baffle plate 12*a* by this elasticity. The engaging portion 132 may have a structure including a rubber material therein.

The ear cup 11 includes a headband 14 attached to the substantial center of the outer surface of the ear cup 11. The headband 14 is composed of a resilient member that exerts an pressing force toward the ear pad 13. The other end of the headband 14 is attached to another headphone having the same structure. The cushion of the ear pad 13 can absorb the lateral pressure caused by the headphone 100*b* fixed on user's head and thus enhances the comfort for the user to wear.

A gas permeable buffer 15*a* is disposed between the baffle plate 12*a* and the ear pad 13, a gas permeable buffer 17 having high rigidity is disposed along the inner circumference of the buffer 15*a*, and a gas impermeable buffer 18 having high rigidity is disposed along the outer circumference of the buffer 15*a*. The buffers 15*a*, 17, and 18 each have a sufficient thickness to maintain a sufficient volume of front air chamber 16. The buffers 15*a*, 17, and 18 may be integrated by welding or bonding. The buffers 15*a*, 17, and 18 may each be fixed to the baffle plate 12*a* or the ear pad 13.

The triple layer structure of these buffers can prevent a reduction in volume of the front air chamber 16 caused by lateral pressure even if the baffle plate 12*a* having no rib wall is used. Among them, the buffer 18 used at the periphery is composed of a gas impermeable material having high rigidity and functions as a substitute for the rib wall 121 of the baffle plate 12 described in the first embodiment.

Furthermore, the permeability of the buffer 17 and the buffer 15*a* enables the voids inside the buffer 15*a* to function as part of the volume of the front air chamber 16, providing an increased volume of air chamber 16.

The buffer 15*a* may include an acoustic material having a certain degree of rigidity in place of the cushioning material. The acoustic material in the buffer 15*a* can suppress the generation of peaks and dips in specific frequency bands to further improve the quality of sound.

Thus, the headphone in accordance with the present embodiment including the baffle plate and the buffers having different rigidities provided between the ear pad and the baffle plate can maintain a constant volume of the front air chamber without a reduction in volume caused by lateral pressure when the headphone is worn. This leads to a reduction in a resonant frequency of the front air chamber and improves the quality of sound in low to medium frequency bands.

Industrial Applicability

The present invention can provide a closed-type headphone that can improve the quality of sound in low to medium frequency bands regardless of a circum-aural or supra-aural type.

What is claimed is:

1. A headphone comprising:

a headband;

an ear cup attached to the headband;

a baffle plate fixed to the ear cup and having a rib wall at its periphery;

an ear pad engaged with the baffle plate; and a gas-permeable buffer between the ear cup and the baffle plate, wherein the buffer and the rib wall prevent a reduction in volume of a front air chamber caused by lateral pressure, and wherein the buffer comprises a first element at an inner periphery, a second element at an intermediate, and a third element at an outer periphery, the first, second, and third buffer elements having different rigidities, wherein the first buffer element comprises a gas-permeable material and has rigidity higher than that of the second buffer element, and the third buffer element comprises a gas-impermeable material and has rigidity higher than that of the second buffer element, the third buffer element functioning as a substitute for the rib wall.

2. The headphone of claim 1, wherein the buffer is a cushion.

3. The headphone of claim 1, wherein the buffer comprises an acoustic material having gas permeability.

4. The headphone of claim 1, wherein the buffer has a thickness greater than that of the ear pad.

5. The headphone of claim 1, wherein the buffer is more rigid than the ear pad.

6. The headphone of claim 1, wherein the baffle plate has a plurality of rib walls disposed inward of the ear pad in the radial direction.

* * * * *